United States Patent [19]

Feldinger

[11] Patent Number: 4,955,349

[45] Date of Patent: Sep. 11, 1990

[54] DEVICE FOR PREPARATION OF A FUEL-AIR MIXTURE FOR INTERNAL COMBUSTION ENGINES

[75] Inventor: Martin Feldinger, Königstein, Fed. Rep. of Germany

[73] Assignee: VDO Adolf Schindling AG, Frankfurt, Fed. Rep. of Germany

[21] Appl. No.: 219,313

[22] Filed: Jul. 15, 1988

[51] Int. Cl.[5] ..... F02M 39/00

[52] U.S. Cl. ..... 123/531; 123/585; 261/44.5

[58] Field of Search ..... 123/531, 585, 590, 337, 123/445; 261/44.5

[56] References Cited

U.S. PATENT DOCUMENTS

| | | | |
|---|---|---|---|
| 1,901,849 | 3/1933 | Moore | 123/531 |
| 1,973,496 | 9/1934 | Moore | 123/531 |
| 1,990,702 | 2/1935 | Leibing | 261/44.5 |
| 2,056,615 | 10/1936 | Moore | 123/531 |
| 2,544,111 | 3/1951 | Schneebeli | 261/44.5 |
| 2,646,264 | 7/1953 | Morris | 261/44.5 |
| 2,740,391 | 4/1956 | Busch | 123/737 |
| 3,564,580 | 2/1971 | Ginque | 123/585 |
| 4,132,752 | 11/1979 | Petermann | 261/44.5 |
| 4,455,979 | 6/1984 | Brown | 261/44.5 |
| 4,702,209 | 10/1987 | Sausver | 123/585 |

FOREIGN PATENT DOCUMENTS

| | | |
|---|---|---|
| 0084639 | 6/1987 | European Pat. Off. . |
| 1600802 | 10/1981 | United Kingdom . |

*Primary Examiner*—Carl Stuart Miller

*Attorney, Agent, or Firm*—Martin A. Farber

[57] ABSTRACT

In a fuel/air mixture preparation device for internal combustion engines, there is a nozzle body (2) of rotational symmetry having a throttle member (7) of rotational symmetry which is displaceable within the body, the body forming a convergent/divergent nozzle. With the throttle member (7), which is displaceable in the nozzle body, the main air-mass throughput through the nozzle is determined. At least one fuel feed line (8 and 9) enters into the nozzle body. The fuel feed line has a circumferential fuel slot (10) which is developed in the wall of the nozzle body as well as a circumferential fuel/air slot (12) which joins it and is open towards the inside in the nozzle body. At a transition place between the fuel slot and the fuel/air slot there debouches an air feed (13) which is approximately under ambient air pressure. From a gap opening (11) of the fuel/air slot, the fuel mixed with air is injected approximately transversely to the direction of the main air mass flow, into the inside of the nozzle body.

7 Claims, 3 Drawing Sheets

DEVICE FOR PREPARATION OF A FUEL-AIR MIXTURE FOR INTERNAL COMBUSTION ENGINES

FIELD AND BACKGROUND OF THE INVENTION

The present invention refers to a fuel/air mixture preparation device for internal combustion engines, the device having a nozzle body of rotational symmetry which, together with a throttle element of rotational symmetry which is displaceable within the body, forms a convergent-divergent nozzle directed into an intake tube of the internal combustion engine, and wherein the device includes at least one fuel feed line which opens into the nozzle in the vicinity of a narrowest cross section of the nozzle.

With such a known fuel/air mixture preparation device, it is endeavored optimally to control both the atomization of the fuel and the mass throughput of the intake air over operating range of the internal combustion engine which is fed this fuel/air mixture. This is achieved in accordance with the principle that liquid fuel be introduced into the intake air stream and distributed as uniformly as possible with a stream of air flowing flows through a constricted cross section of the mixture preparation device wherein, the speed of the air increases to above the speed of sound. The fuel is thereby divided into fine droplets The free cross sectional area of the stream of air between the nozzle body and a axially adjustable throttle element can also be changed similarly, the amount of fuel introduced can be controlled.

Downstream of the narrowest cross section in the nozzle body, the stream of air and the particles of fuel contained therein are accelerated to supersonic speed; This mixture is then again retarded in an impact zone to a lower speed, lying below the speed of sound, before the fuel/air mixture passes into the cylinders of the combustion engine. The space within this nozzle body is limited by a wall which initially tapers down in the direction of the stream of air drawn in and then, starting at the narrowest cross sectional place, again widens in a so-called diffuser Both the nozzle body and the throttle element are developed in this connection with substantially rotational symmetry about a longitudinal axis which also represents the main direction of flow of the air drawn in.

This aspect of the mixture preparation device, causes an asymmetric distribution of the fuel in the air drawn in, as occurs generally in carburetors with pivoted throttle valves is to be avoided. Furthermore, as compared with well-known carburetors, there is a disadvantage in that the composition of the fuel/air mixture is subjected to strong variations as a function of the flow of air through the carburetor. This disadvantage is to be solved by the invention.

In connection herewith, it is undesirable that the fuel/air mixture be, on the one hand, too rich so that the fuel cannot burn completely in the cylinders or, on the other hand, too lean, as a result of which misfiring can take place. The excessively rich mixture not only reduces the efficiency of the internal combustion engine but also results, in particular, in an increased emission of contaminating substances.

A substantial factor for avoidance of the disadvantages of prior art carburetors with pivoted throttle valve is attained by a feeding of fuel into a space which is limited towards the inside by a wall of the throttle element of rotational symmetry. In principle, liquid fuel is to be introduced via conduits into an inwardly drawn stream of air above the narrowest cross sectional place of the nozzle body into the latter. For this purpose, fuel lines are introduced through the wall of the nozzle body into its (inner) space.

In one known variant of this mixture preparation device with nozzle body of rotational symmetry, the feeding of the fuel is effected via a fuel nozzle which is located above the throttle element along the longitudinal axis of the nozzle body of rotational symmetry. The air-intake fuel nozzle is fed with air which is under pressure as well as with a controlled flow of fuel. The opening of the nozzle faces a baffle plate by which the fuel is to be injected radially in substantially symmetrical distribution into the space within the nozzle. The nozzle is in this connection developed as air-intake nozzle. The liquid fuel which is sprayed by this nozzle reaches the inner surface of the wall in the nozzle body and travels down along the inclined wall to the place of narrowest cross section. In this connection, the downward flowing quantity of fuel is to be substantially uniformly distributed over the circumference of the wall. In the region of the place of narrowest cross section, the fuel is detached from the wall by the air which is flowing with high speed and is distributed in fine form in the air.

In another known embodiment, the feeding of compressed air to the nozzle is dispensed with. In furtherance of the last-mentioned principle, the feeding of the fuel has been so modified that it takes place through a conduit over an annular body into which the nozzle body of rotational symmetry is inserted, which nozzle body tapers down on the inside down to its place of narrowest cross section. Between the annular body and the nozzle body there is thus formed a cylindrical slot, the slot opening of which is limited by the upper edge of the nozzle body.

Thus the fuel conveyed through this cylindrical fuel slot travels over the upper edge of the nozzle body over its entire length, down to the place of narrowest cross section where, in the manner indicated, it is to be detached by air flowing at high speed from the inner surface of the wall of the nozzle body to be atomized. As a result of the adherence forces between the film of fuel and the wall, only a part of the fuel, however, is actually atomized. In this development of the device for the preparation of the mixture, changes in the metering of the fuel furthermore act only with delay on the fuel/air mixture formed, since the fuel must first of all flow down on the inner surface of the wall of the nozzle body until it passes, substantially at the point of narrowest cross section, into the fuel/air mixture. In other words, changes in pressure and/or flow in the fuel line do not result directly in suitable preparation of the mixture since the volume of fuel can spread out outside the annular body.

SUMMARY OF THE INVENTION

The object of the present invention is so to develop a fuel/air mixture preparation device of the aforementioned type that it forms without delay a homogeneous fuel/air mixture containing a predominant portion of very small droplets of fuel.

This is achieved by the development of the fuel/air mixture preparation device with the features wherein a fuel-air slot (12) circumscribes the convergent-divergent nozzle (4), has a rotating slot opening (11) debouching into the nozzle (4), and is in communication at a transition point with a circumferential fuel slot (10) and a circumferential air feed (13). Therein, approximately ambient air pressure prevails, so that fuel premixed with air is injected from the slot opening (11), into the nozzle (4) approximately transversely to the direction of the main air mass flow.

By the development of the mixture-preparation device in accordance with the invention, the result is obtained that changes in the metering of the fuel to the mixture-preparation device act practically without delay on the resultant fuel/air mixture, the formation of the mixture commencing essentially at or just in front of the narrowest point in the convergent/ divergent nozzle, and continuing downstream. Changes in the metered fuel propagate immediately to the slot opening in the inner surface of the nozzle body. The fuel is fed through the circumferential, i.e., annular, fuel slot uniformly over the circumference of the fuel/air slot which adjoins it in the direction of the flow of the fuel. The fuel is fed through said fuel/air slot and further under the action of air which is approximately under atmospheric pressure, premixed with said air, injected effectively into the nozzle approximately transverse to the direction of the main airmass flow for further atomization into very fine particles. For this purpose, the fuel slot is connected with an also circumferential annular air channel into which air is fed under approximately ambient air pressure and thus, in any event under specified operating conditions, with a higher pressure than the air pressure surrounding the slot opening. By this arrangement, the formation of vapor bubbles in the fuel is furthermore counteracted.

The advantage of the fuel/air slot is in general that by it, with a low fuel flow through the fuel slot, a premixing of the fuel with the air takes place, and atomization within the drawn-in stream of air within the nozzle body is thus supported. Particularly good homogeneity of the mixture formed is obtained, also for the reason that the fuel need no longer be detached from the inner surface of the wall of the nozzle body by the stream of air of high velocity of flow, only after which the actual formation of the mixture can commence, but rather the fuel is injected from the slot opening, uniformly over the circumference thereof, freely into the convergent-divergent nozzle so that it is immediately taken up completely by the main air-mass flow. The fuel slot is so shaped that, under the given pressure conditions in the fuel slot and around its opening to the inner space in the nozzle body, the emergence of the fuel from the slot opening takes place with a sufficiently high velocity that it is not forced again, under the action of the stream of inward drawn air against the inner surface of the wall of the nozzle body.

In contradistinction to a central nozzle baffle-plate arrangement in the longitudinal axis of the nozzle body of rotational symmetry, a uniform distribution of fuel over the circumference of the wall, and thus a particularly homogeneous mixture formation, is obtained by the slot formed in the wall of the nozzle body, which slot lies in a cross sectional plane of the nozzle body and is open in the region of the place of narrowest cross section The last-mentioned advantage is further enhanced by the fact that the circumferential fuel slot is developed as a so-called laminar throttle wherein a circumferential fuel-air slot (10) is developed as a laminar throttle in front of which an annular fuel channel (9) is arranged. The expression "laminar throttle" means that the flow in the circumferential slot, which is only of slight height - in the direction of the longitudinal axis of the nozzle body of rotational symmetry - always remains laminar.

Due to this, the formation of vapor bubbles in the flow of fuel in front of the annular air channel is prevented. At the same time, as a result, the velocity of the flow of fuel is increased in the portion of the laminar throttle between annular air channel and slot opening, particularly in the case of small rates of flow of fuel, whereby the quality of the formation of the mixture is further improved.

In a particularly simple but effective manner, the air pressing the fuel out of the fuel/air slot is diverted, from the drawn-in stream of air in the nozzle body by a structure wherein circumferential air feed (13) is in communication via holes (14, 15) in the wall (4) of the nozzle body with the space in the nozzle body upstream of the slot opening (11), in which approximately ambient air pressure prevails. Therefore, no additional production of pressure by separate operating means is necessary.

In one advantageous variant of the fuel/air mixture preparation device, downstream of the fuel/air slot, a circumferential air slot, which is preferably developed from the wall of the nozzle body, is arranged in a cross sectional plane which lies lower than the slot opening of the fuel/air slot. The air slot is also open towards the inside of the nozzle body. It is connected with an annular feed for air which is approximately under atmospheric air pressure. In this way, assurance is had that the fuel which, despite the measures described above, tends to flow down on the inner surface of the wall is detached from the wall in addition to the action of the intake stream of air so as to be mixed in the best possible manner with the stream of air.

In a further aspect of the mixture-preparation device, the nozzle element (21) has a concentric circumferential air slot (22) and is connected with a feed line for air which is approximately under ambient air pressure. This provides assurance that no fuel is deposited on the throttle body in undesired manner.

In addition, the throttle member can advantageously be developed to provide that the throttle element (31) has a fuel nozzle (34) which lies in the longitudinal axis (32) and sprays fuel in the lower operating range of the internal combustion engine into the convergent-divergent nozzle. In this way, it is possible to feed the fuel in the lower operating region, when idling or when the internal combustion engine is under no load, solely over the throttle element into the inside of the nozzle body. This mass of fuel is effectively atomized only by a mass of air which corresponds at most to the amount for the lower idle region. Only in the higher operating region of the internal combustion engine is additional fuel fed via the fuel/air slot in the wall of the nozzle body.

In order definitely to avoid a depositing of fuel on the inner surface of the wall of the nozzle body, downstream of an edge (40) which limits the slot opening (39) of the fuel-air slot (37), a detachment edge (41) is provided for the fuel. A particularly compact embodiment is attained by providing that the fuel-air slot (12), the fuel slot (10), the fuel annular channel (9) as well as the air feed (13) are formed from the wall of the nozzle body (2).

BRIEF DESCRIPTION OF THE DRAWINGS

The invention will be described below with reference to the four figures of the drawing, in which.

DETAILED DESCRIPTION OF THE PREFERRED EMBODIMENTS

In all figures the fuel/air mixture preparation device has been shown enlarged.

Figure 1:
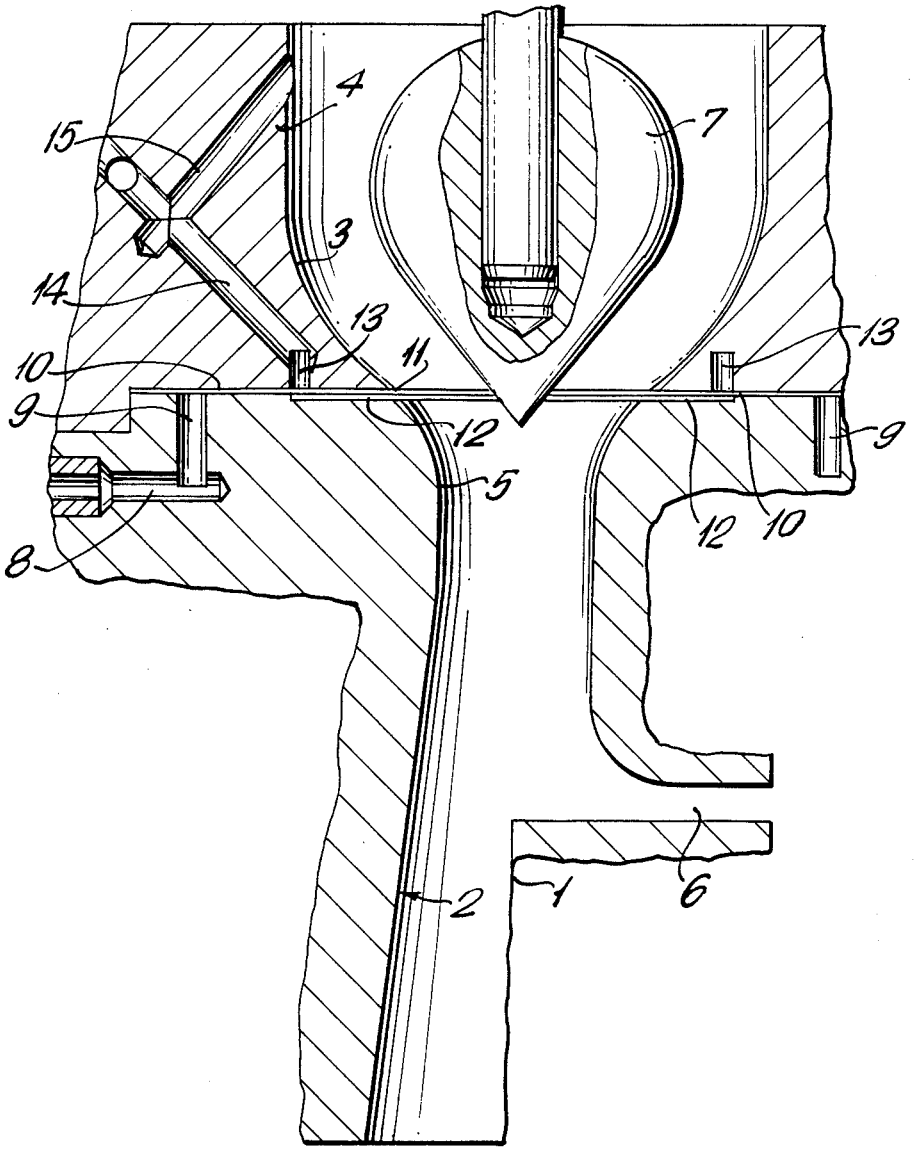
FIG. 1 is a first embodiment of the fuel/air mixture preparation device, shown in longitudinal section.

In FIG. 1, an imaginary longitudinal axis of the fuel-/air mixture preparation device, around which parts of this mixture preparation device are symmetrically developed, is designated by the numeral 1. A nozzle body 2 with its inner wall 3 is developed with essentially rotational symmetry. The inner space limited by the inner wall within the nozzle body is cylindrical in its upper region and then tapers continuously downward to a place 5 of narrowest inside cross section. From there, the space widens downward in diffuser-like fashion. The diffuser can be connected to an intake pipe (not shown) of an internal combustion engine. At the top, the fuel/air mixture preparation device is fed with air via an air filter, also not shown. The main air-mass flow therefore flows from the top to the bottom. In the right-hand lower part of the fuel/air mixture preparation device referred to the longitudinal axis 1, a radial diffuser 6 for connection to the intake pipe of the internal combustion engine is shown as variant. The radial diffuser can have, in particular, advantages as to space over the normal diffuser shown in the corresponding left-hand part of the drawing.

In order to regulate the main air-mass flow, there is used, in combination with the nozzle body, a throttle element 7 which is also shaped with rotational symmetry around the longitudinal axis and which is adjustable in the direction of the longitudinal axis. An essential lower part of the throttle member is tapered continuously from the top to the bottom for this purpose. The passage for the air mass flow between the nozzle body and the throttle member is, therefore, constricted to a greater and greater extent the further the throttle member is pushed downward. With the throttle member, the nozzle body forms a convergent-divergent nozzle.

For the feeding of fuel into the inside of the nozzle body, the wall of the latter is provided with a fuel feed bore 8 which passes, via a fuel annular channel 9, into a fuel slot 10. The fuel slot lies in a cross sectional plane somewhat upstream of the narrowest clear cross section and passes into a fuel/air slot 12 which has a slot opening 11 directed towards the inside of the nozzle body. The slot opening therefore extends over 360° in the same way as the circumferential fuel/air slot and fuel slot. For the uniform distribution of the stream of fuel entering the nozzle body via its circumference, the fuel annular channel is developed with relatively small resistance to flow while the fuel slot has a relatively high resistance to flow. In an inner position adjacent to the slot opening, the fuel slot widens to the fuel/air slot 12.

In addition to fuel, air under higher pressure is introduced approximately under ambient air pressure into the fuel slot. For this purpose, the fuel slot is connected via an annular air feed 13 and bores 14, 15 to an inner-space section in the nozzle body in which the air pressure of the surroundings substantially prevails, while an air pressure of about one-half the ambient pressure prevails in the slot opening 11 when the air flows with the velocity of sound at this place. By the air feed 13, the formation of vapor bubbles is avoided since the fuel is practically under atmospheric pressure here. The air feed and the fuel/air slot adjacent it are so dimensioned that some air mixes with the fuel in them. In that way, the fuel emerging from the slot opening 11 is imparted a higher velocity than without such admixture of air. This is particularly important for small flows of fuel in order that they definitely enter into the inside of the nozzle body and thus into the main air-mass flow without substantially being deposited on the inner wall 3 of the nozzle body as a result of adherence. In this way, a good mixing of the fuel with the air flowing through the nozzle body is assured, with the fuel being divided up into very fine droplets. The fuel, which flows with high velocity out of the slot opening, strikes practically perpendicularly against the stream of air. The relative velocity between the fuel and the air in the nozzle body is therefore high at this place.

Due to the homogeneous mixing of the air throughput with very fine particles of fuel, all cylinders of the combustion engine are filled with the fuel/air mixture for uniform production of power with maximum engine power and reduced fuel consumption. From this, there also results a decrease in the content of pollutants in the exhaust gas. Summarizing therefore, it is essential that the feeding of fuel to the combustion air or the air mass flow take place uniformly and in film-like manner over the circumference of the nozzle body.

Figure 2:
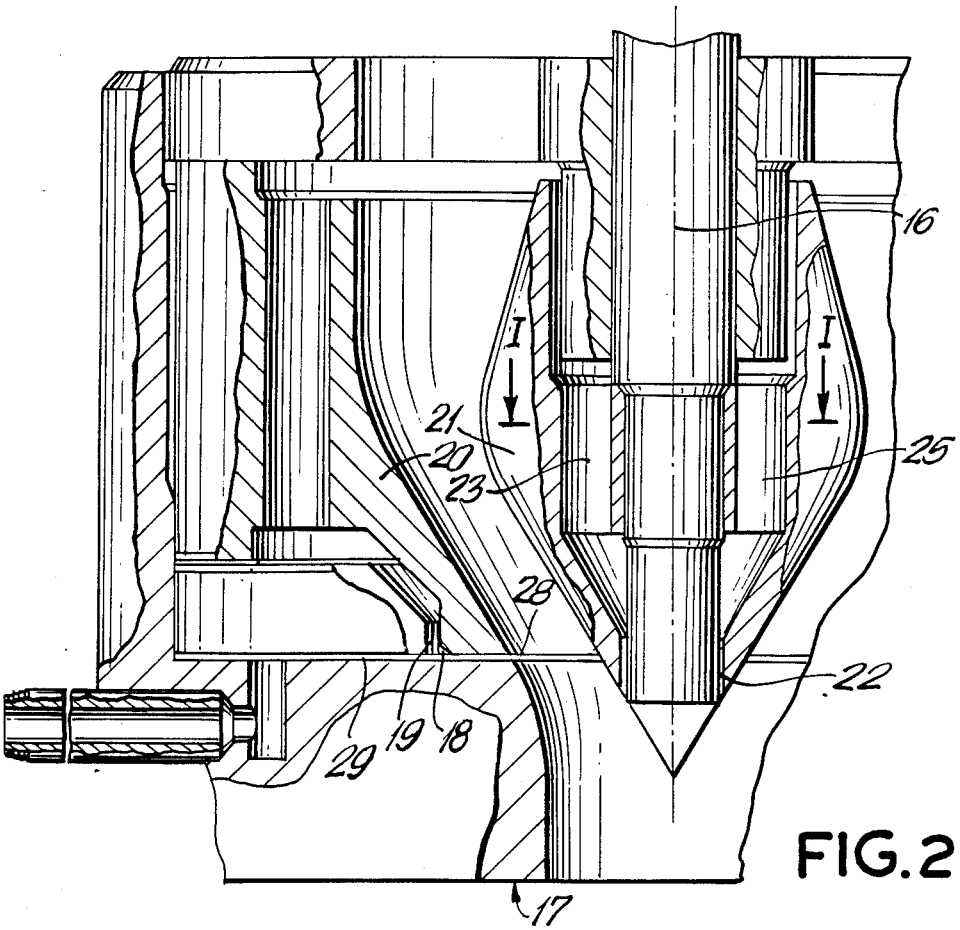
FIG. 2 is a second embodiment, also in longitudinal section.
Figure 3:
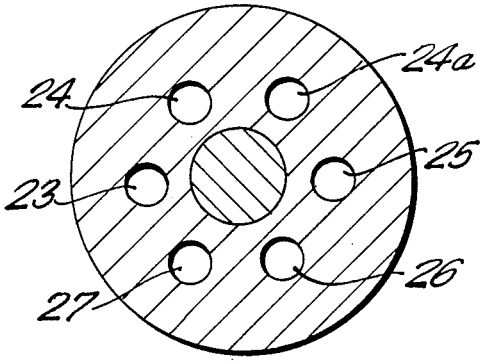
FIG. 3 is a cross section through the throttle element along the line 1—1 of FIG. 2.

The second variant, the fuel/air mixture preparation device of FIGS. 2 and 3, is also developed substantially with rotational symmetry around a longitudinal axis 16. The diffusor is not shown in these figures. The feeding of the air of increased pressure from the upper part of the space in the nozzle body 17 is slightly modified as compared with the first embodiment. It may be pointed out that in this case the air annular channel 19 is provided with a bevel 18 which debouches into a transition place from a fuel slot 29 to a fuel-air slot.

In the embodiment of FIG. 2, it is essential that, in this case, there be arranged in a throttle member 21, a circumferential air slot 22 which is in communication via holes 23 to 27 — see FIG. 3 — with the upper part of the inside of the nozzle body, within which approximately ambient air pressure prevails, while at the opening of the circumferential air slot a lower pressure, typically about one-half, is present when the main air mass flow flows with the velocity of sound within the narrowest cross section. This has the result that the fuel flowing with high velocity out of the slot opening 28 and arriving in part on the wall of the throttle element is blown away from the throttle element and is finely atomized, particularly when, with small main air mass flow in and in the vicinity of the motor idle, the throttle element is located near the wall of the nozzle body.

Figure 4:
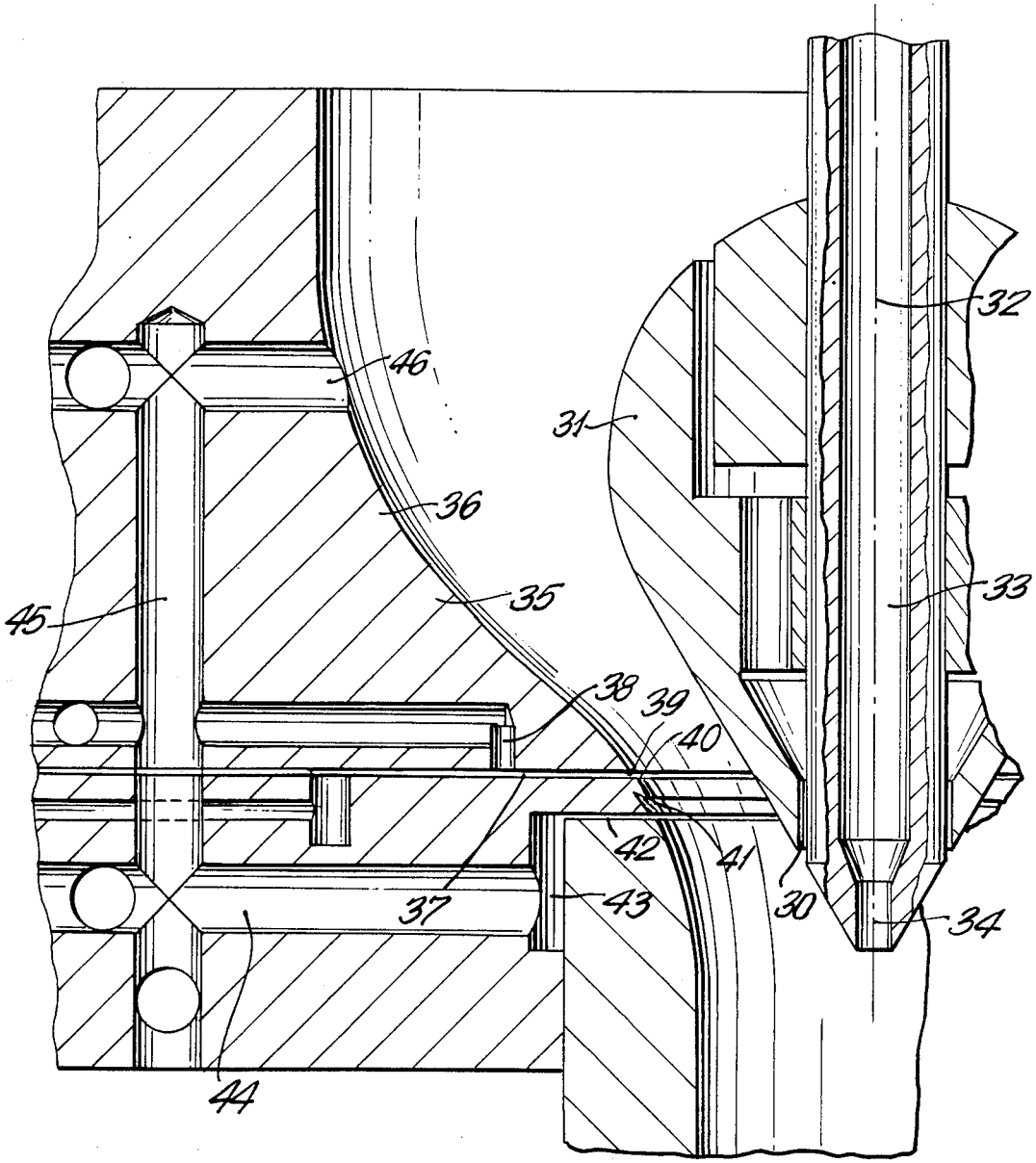
FIG. 4 is a third embodiment, also in a longitudinal section.

As also shown in FIG. 4, an air slot 30 can be formed cylindrically within a throttle element 31 and arranged concentric to a longitudinal axis 32.

The embodiment of FIG. 4 is particularly suitable when the fuel required for the idling operation of the engine is fed and atomized via the throttle element. The throttle member serves to feed fuel via a central bore 33 which passes into a fuel nozzle 34. The further mass of air necessary to obtain the optimum composition of the mixture is determined via the variable position of the throttle member 31; it flows between the throttle member and an inner wall 35 of the nozzle body 36. For the higher operating range, the feeding of fuel then takes place, in addition, through a circumferential fuel slot 37 arranged in the nozzle body. An annular air channel 38 again debouches into the fuel slot. As can be noted in detail from FIG. 4, below the slot opening 39, there is arranged a detachment edge 41, for the part of the fuel which flows down between an upper edge 40 and the detachment edge 41. A detachment of the flow of air of the main air mass flow flowing through the nozzle body is, however, not to take place, due to this configuration of the edges.

Another feature of the embodiment of FIG. 4 consists of a circumferential air slot 42 which is formed from the nozzle body below the fuel slot 37. The circumferential air slot is in communication, via an air annular channel 43 and holes 44 to 46, with the upper space in the nozzle body, in which approximately atmospheric pressure prevails. By the circumferential air slot 52, the purpose is also achieved that any film of fuel which, in the most unfavorable case, downstream of the slot opening 39 of the fuel air slot 37 is finely atomized by the main air mass flow.

I claim:

1. A fuel-air mixture preparation device for internal combustion engines, the device comprising a nozzle body of rotational symmetry and a throttle element of rotational symmetry which is displaceably mounted within the body, the nozzle body and the throttle element forming a convergent-divergent nozzle which is configured for debouching into an intake tube of the internal combustion engine;

at least one fuel feed line which opens into said nozzle alongside the narrowest nozzle cross section;

a fuel-air slot which circumscribes said convergent-divergent nozzle and has a slot opening encircling said nozzle, the fuel-air slot opening into the nozzle;

a fuel slot and an air feed which are disposed in said nozzle body circumferentially around said nozzle to define a transition point in said nozzle, said air-fuel slot being in communication at the transition point with said circumferential fuel slot and said circumferential air feed, said fuel-air slot extending radially with uniform thickness from said slot opening to said transition point, there being approximately ambient air pressure at said air feed to enable fuel premixed with air to be injected from said fuel-air slot opening into said nozzle approximately transversely to the direction of main air mass flow; and an annular fuel channel disposed in said nozzle body in front of said fuel-air slot, said fuel-air slot cooperating with said fuel channel to form said throttle element as a laminar throttle.

2. A fuel-air mixture preparation device according to claim 1, further comprising holes in a wall of said nozzle body, said circumferential air-feed communicating via said holes with a space in said nozzle body upstream of said fuel-air slot opening, in which space approximately ambient air pressure prevails.

3. A fuel-air mixture preparation device for internal combustion engines, the device comprising a nozzle body of rotational symmetry and a throttle element of rotational symmetry which is displaceably mounted within the body, the nozzle body and the throttle element forming a convergent-divergent nozzle which is configured for debouching into an intake tube of the internal combustion engine;

at least one fuel feed line which opens into said nozzle alongside the narrowest nozzle cross section;

a fuel-air slot which circumscribes said convergent-divergent nozzle and has a slot opening encircling said nozzle, the fuel-air slot opening into the nozzle;

a fuel slot and an air feed which are disposed in said nozzle body circumferentially around said nozzle to define a transition point in said nozzle, said air-fuel slot being in communication at the transition point with said circumferential fuel slot and said circumferential air feed, there being approximately ambient air pressure at said air feed to enable fuel premixed with air to be injected from said fuel-air slot opening into said nozzle approximately transversely to the direction of main air mass flow;

an air slot formed in a wall of said nozzle body circumferentially about said nozzle;

an annular feed for air which is approximately under ambient air pressure; and wherein with reference to the main air mass flow, said circumferential air slot is located downstream of said circumferential fuel-air slot, said air slot opening towards the inside of the nozzle body and connecting with said annular feed.

4. A fuel-air mixture preparation device for internal combustion engines, the device comprising a nozzle body of rotational symmetry and a throttle element of a rotational symmetry which is displaceably mounted within the body, the nozzle body and the throttle element forming a convergent-divergent nozzle which is configured for debouching into an intake tube of the internal combustion engine;

at least one fuel feed line which opens into said nozzle alongside the narrowest nozzle cross section;

a fuel-air slot which circumscribes said convergent-divergent nozzle and has a slot opening encircling said nozzle, the fuel-air slot opening into the nozzle;

a fuel slot and an air feed which are disposed in said nozzle body circumferentially around said nozzle to define a transition point in said nozzle, said air-fuel slot being in communication at the transition point with said circumferential fuel slot and said circumferential air feed, there being approximately ambient air pressure at said air feed to enable fuel premixed with air to be injected from said fuel-air slot opening into said nozzle approximately transversely to the direction of main air mass flow; and an air-feed line, and a nozzle element formed within said nozzle body, said nozzle element having a concentric circumferential air slot and being connected with said air feed line.

5. A fuel-air mixture preparation device for internal combustion engine, the device comprising a nozzle body of rotational symmetry and a throttle element of rotational symmetry which is displaceably mounted within the body, the nozzle body and the throttle element forming a convergent-divergent nozzle which is configured for debouching into an intake tube of the internal combustion engine;

at least one fuel feed line which opens into said nozzle alongside the narrowest nozzle cross section;

a fuel-air slot which circumscribes said convergent-divergent nozzle and has a slot opening encircling said nozzle, the fuel-air slot opening into the nozzle;

a fuel slot and an air feed which are disposed in said nozzle body circumferentially around said nozzle to define a transition point in said nozzle, said air-fuel slot being in communication at the transition point with said circumferential fuel slot and said circumferential air feed, there being approximately ambient air pressure at said air feed to enable fuel premixed with air to be injected from said fuel-air slot opening into said nozzle approximately transversely to the direction of main air mass flow; and said throttle element has a further nozzle which lies in the longitudinal axis for spraying fuel, during a lower operating range of the internal combustion engine, into the convergent-divergent nozzle.

6. A fuel-air mixture preparation device according to claim 1, wherein said fuel-air slot has a limiting edge which limits a slot opening of said fuel-air slot, and a detachment edge for the fuel located downstream of said limiting edge.

7. A fuel-air mixture preparation device according to claim 1, further comprising a fuel annular channel concentric to said nozzle and communicating with said fuel slot; and wherein said fuel-air slot, said fuel slot, said fuel annular channel, and said air feed are formed from a wall of said nozzle body.

* * * * *